United States Patent [19]

Hannesson et al.

[11] Patent Number: 4,667,993

[45] Date of Patent: May 26, 1987

[54] TRUNK LID HOLDING DEVICE

[76] Inventors: James H. Hannesson, 21916-50th Ave., Langley, British Columbia, Canada, V3A 3T3; Timothy C. Eaton, 27 Haliburton Bay, Winnipeg, Manitoba, Canada, R3K 1E1

[21] Appl. No.: 676,436

[22] Filed: Nov. 15, 1984

[51] Int. Cl.[4] ..... E05C 17/54

[52] U.S. Cl. ..... 292/339; 24/298

[58] Field of Search ..... 292/339, 288, 262, 264, 292/305; 24/298, 300, 301; 70/54–56

[56] References Cited

U.S. PATENT DOCUMENTS

| | | | |
|---|---|---|---|
| 797,562 | 8/1905 | Crofford | 292/277 |
| 2,618,497 | 11/1952 | Gardels | 292/288 X |
| 2,889,165 | 6/1959 | Zientara | 24/300 X |
| 3,174,787 | 3/1965 | Kolman | 292/288 |
| 3,195,940 | 7/1965 | Woodling | 292/262 |
| 3,453,846 | 7/1969 | Owen et al. | 70/54 |
| 4,062,577 | 12/1977 | Butterfield et al. | 292/262 |
| 4,070,050 | 1/1978 | Glock | 292/339 |
| 4,506,528 | 3/1985 | Eberly | 70/54 X |

FOREIGN PATENT DOCUMENTS

| | | | |
|---|---|---|---|
| 2747096 | 5/1979 | Fed. Rep. of Germany | 292/262 |
| 8264 | of 1901 | United Kingdom | 70/54 |

*Primary Examiner*—Robert L. Wolfe
*Assistant Examiner*—Lloyd A. Gall
*Attorney, Agent, or Firm*—Stanley G. Ade; Adrian D. Battison

[57] ABSTRACT

It consists of a cylindrical tube carrying a spring inside with a hook on one end to engage the fixed trunk hasp and a ring or closed loop on the other end to be lockably engaged by the trunk latching mechanism usually carried on the trunk lid. Once the hook is engaged with the fixed ring of the trunk, the lower end of the tube is manipulated so that a pair of opposed slots in the lower end of the wall of the tube engage upon the ring or hasp of the trunk so that the spring is under relatively heavy tension and thus acts as a substantially rigid link when the trunk lid is closed and locked upon the other end of the spring.

21 Claims, 13 Drawing Figures

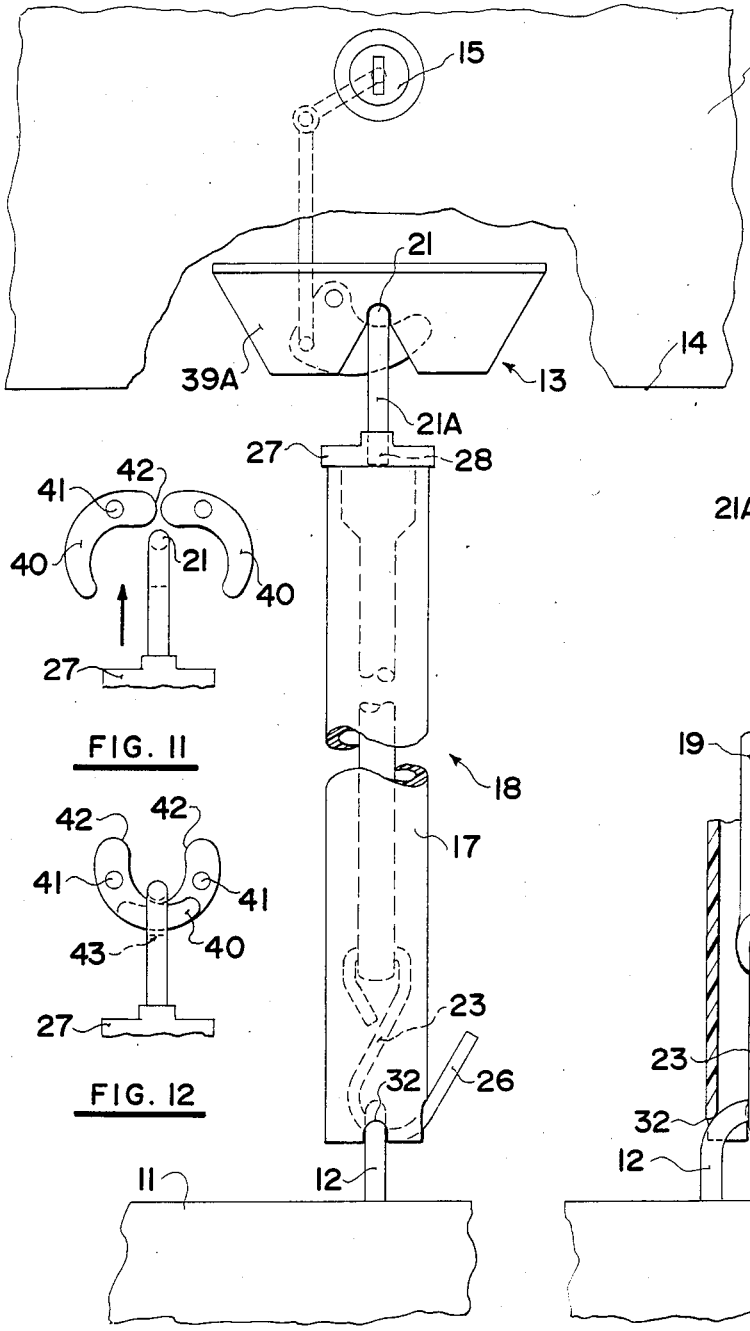
FIG. 6
FIG. 11
FIG. 12
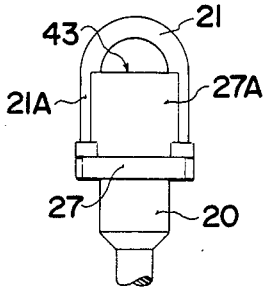
FIG. 13
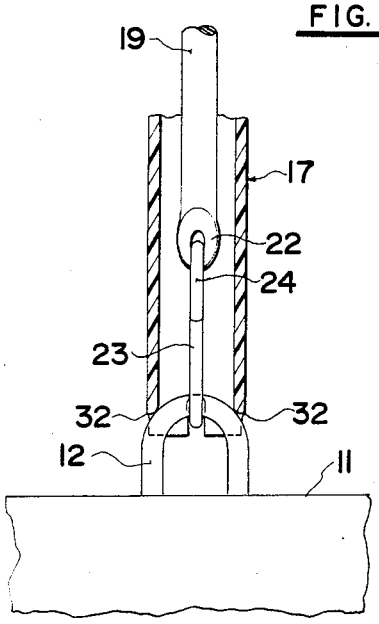
FIG. 7

TRUNK LID HOLDING DEVICE

BACKGROUND OF THE INVENTION

This invention relates to new and useful improvements in detachable latching devices for car trunks or the like in which the trunk or cargo lid may be maintained in a fixed, partially open position primarily so that venting of the trunk space or cargo space may take place.

When transporting propane and industrial gas cylinders, it is essential that the trunk be vented. Conventionally the trunk lid is maintained in a partially open position by means of cord or rubber springs which allows the trunk to bounce continuously particularly if travelling over rough roads. This not only may cause damage to the trunk hinge mechanism but the bouncing action may be severe enough so that downward movement causes the trunk lid to strike the cylinders with damage possibly occurring both to the trunk lid and the cylinders.

Although the present device is designed specifically for use in venting cargo spaces or automobile trunks when carrying propane or industrial cylinders, nevertheless it will be appreciated that it is equally applicable in use if slightly oversized packages are being carried by the automobile or truck.

Prior art devices include U.S. Pat. No. 2,919,946 which shows a latching device extending between the trunk lid and the bumper of the car. However, this cannot be locked in position so that the trunk lid may easily be opened by other than authorized personnel.

U.S. Pat. No. 3,174,787 shows an adjustable tension strap between the trunk and the bumper but this suffers from the bounce characteristics hereinbefore described.

The closest art known to applicant is U.S. Pat. No. 4,070,050 which shows a telescopic rod assembly having a resilient base and which may be engaged between the fixed hasp of the trunk assembly and the locking mechanism thereof. However, once again, this is easily detached by unauthorized personnel either by manipulating the device to disengage the hook end from the hasp or by releasing the telescopic assembly by undoing the clamp bolt.

SUMMARY OF THE INVENTION

The present device overcomes all of the disadvantages inherent with prior devices and in accordance with the invention there is provided a device for holding the trunk lid of an automobile or the like, in the partially opened position, said automobile including a lid lock engaging hasp situated adjacent the edge of the cargo space enclosed by the lid and a conventional snap lock mechanism on the trunk lid cooperatively engaging with the hasp to detachably secure said lid in the closed position; said device comprising in combination an open ended tube, a tension spring member extending freely there through, a snap lock engaging member secured to one end of said resilient spring member, means restricting the movement of said snap lock engaging member into one end of said tube, hook means on the other end of said tension spring member engagable with the associated lid lock engaging hasp and means on the other end of said tube selectively engagable with the outer surface of the associated lid lock engaging hasp when said hook means is engaged with said lid lock engaging hasp, said tension spring member being under relatively heavy tension at least when said means on the other end of said tube is selectively engagable with the outer surface of the associated lid lock engaging hasp so that it acts as a substantially rigid link between the associated trunk lid and the edge of the cargo space, when installed.

A further advantage of the invention is to provide a device of the character herewithin described which is easily installed and detached from the majority of American, Japanese and European automobiles without the necessity of modifications or the use of tools or the like.

Another advantage of the invention is to provide a device which, when installed, resists tampering so that the trunk lid cannot easily be opened by unauthorized individuals.

Yet another advantage of the invention is to provide a device which is easily unlocked by the trunk key when desired, then removed and stored readily and easily for future use.

A still further advantage of the invention is to provide a device of the character herewithin described which is simple in construction, economical in manufacture and otherwise well suited to the purpose for which it is designed.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

FIG. 6 is a partially schematic view showing the device installed between a trunk lid and the edge of the cargo space.

FIG. 7 is an enlarged fragmentary side elevation showing the engagement of the device with the trunk hasp.

FIG. 11 shows a partially schematic view of a double latch type mechanism in the open position.

FIG. 12 is a view similar to FIG. 11 but with the latch mechanism closed over the hasp.

FIG. 13 is a fragmentary side elevation of the hasp per say showing an alternative embodiment.

In the drawings like characters of reference indicate corresponding parts in the different figures.

DETAILED DESCRIPTION

Figure 1:
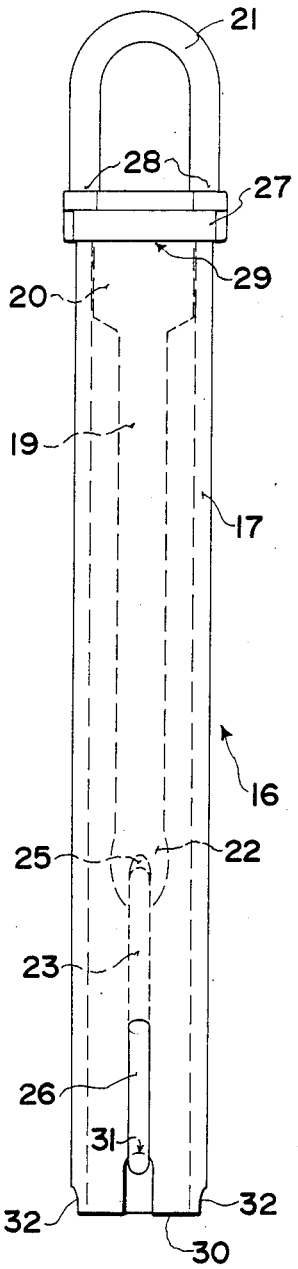
FIG. 1 is a side elevation of the device prior to installation.

Proceeding therefore to describe the invention in detail, reference should first be made to FIG. 6 in which 10 illustrates the lower edge of a conventional trunk which is adapted to engage over the perimetrical edge 11 of a conventional cargo space or trunk space of an automobile.

In the majority of instances, the trunk lid 10 and the edge 11 include means cooperating together to detachably latch and lock the trunk lid in the closed position. Conventionally such means includes a fixed portion 12 consisting of a closed ended loop or hasp secured to the perimetrical edge 11 and a conventional snap lock mechanism 13 secured adjacent the lower edge 14 of the trunk lid and unlocked by means of a key engaging within slot 15.

These snap lock mechanisms are conventional in construction and snap engage over the trunk hasp 12 when the lid is closed. Although the majority of automobiles include the hasp on the perimetrical edge 11 and the locking mechanism on the edge of the trunk lid 10, nevertheless it will be appreciated that some automobiles may have these parts reversed and the description following is applied to both types of construction as it will be appreciated that the device merely has to be reversed in order to operate with the less usual construction.

The device collectively designated 16 consists of an open ended cylinder 17 formed preferably but not necessarily from synthetic plastic.

Figure 2:
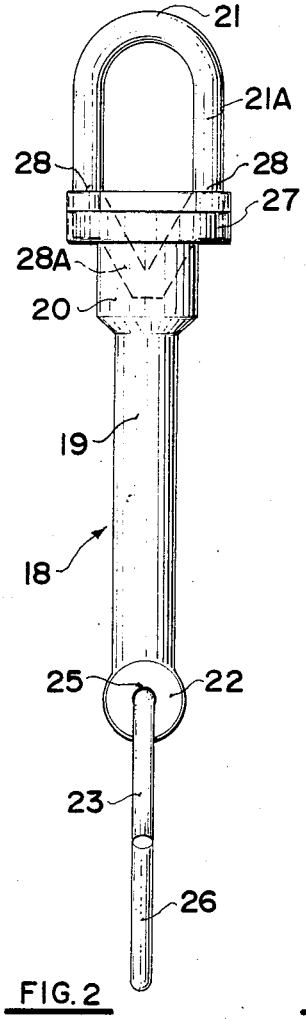
FIG. 2 is a side elevation of the device with the tube removed.
Figure 3:
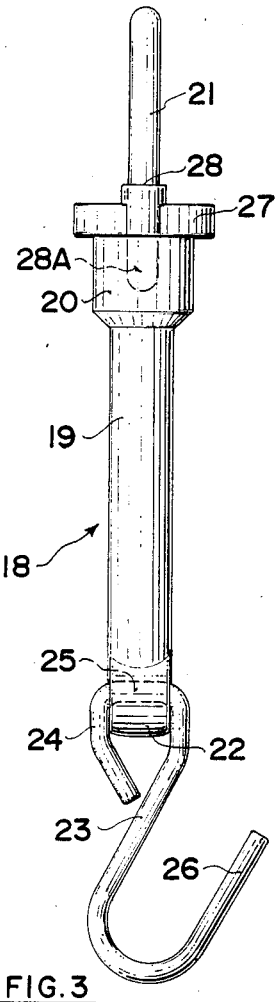
FIG. 3 is a view at right angles to FIG. 2.
Figure 4:
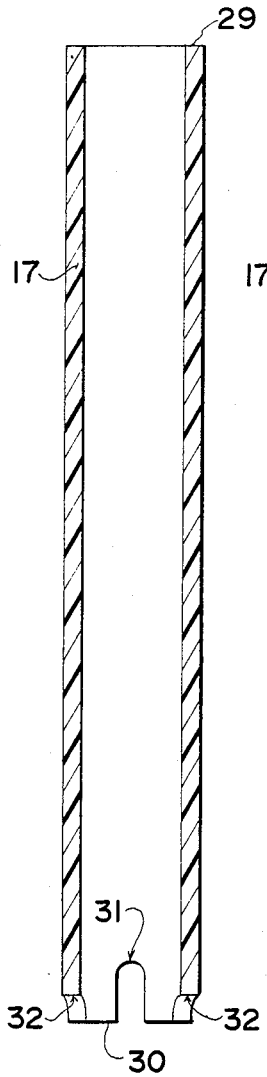
FIG. 4 is a section of the tube per se.
Figure 5:
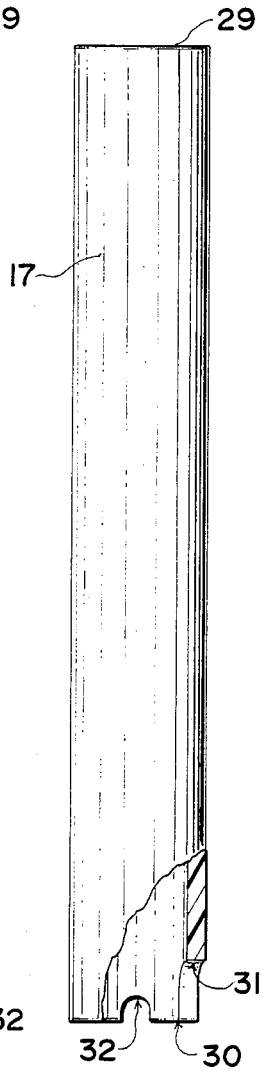
FIG. 5 is a fragmentary section of the tube taken at right angles to FIG. 4.

Situated freely within the device but held by spring tension is a tension spring assembly collectively designated 18 and shown in detail in FIGS. 2 and 3.

It consists of a heavy duty tension spring portion 19 which is preferably formed from an elastomeric material having an enlarged upper end 20 into which is molded a hasp 21 designated as a snap lock engaging member. When embedded during manufacture, the hasp 21 is closed ended and is similar in function to the hasp 12 conventionally forming part of the trunk lid and trunk lock mechanism.

On the lower end of the spring 19, there is formed a boss 22 which is apertured and which receives an S-hook 23, the substantially closed upper end 24 of which engages through the aperture 25 in this boss portion. The lower hooked end 26 of this hook 23 detachably engages the hasp 12 when installed as will hereinafter be described.

However, an enlarged shoulder 27 is provided on the upper end 20 of the spring 18 into which the ends 28 of legs 21A of the hasp are embedded and it will be seen that the diameter of the shoulder is slightly greater than the inside diameter of the tube 18 so that when the spring assembly is engaged downwardly through the tube 17 from the upper end thereof, shoulder 27 and the embedded ends 28 engage the upper end 29 of the tube and therefore cannot penetrate within the tube any further. A further anchoring portion 28A extends between the ends 28 downwardly into the upper end 20.

The length of the elastomeric portion 19 is such that considerable tension is required to pull the hook 23 downwardly through the lower open end 30 where upon it may be engaged within an open based elongated slot 31 formed in the wall of the tube and extending upwardly from the lower end thereof as clearly shown.

When engaged within this slot or notch 31, the spring 18 is under considerable tension whether this spring is of elastomeric material or is a coiled tension spring.

In operation, the trunk lid is released and the portion 26 of the hook 23 is freely engaged with the lid lock engaging hasp 12 whereupon the tube 17 is manipulated so that it engages the outer surface of the hasp as shown in FIG. 6. In this regard, a pair of open ended recesses 32 are formed in the lower end 30 of the tube diametrically opposite to one another and each being approximately 90° axially from the slot 31. When these two notches 32 are engaged upon the hasp 12, the spring 18 is under slightly greater tension and the assembly is held erect by this tension to facilitate the engagement of the conventional snap lock mechanism 13 as the trunk lid is lowered so that this snap lock mechanism engages the upper snap lock engaging hasp 21 of the assembly. Once the lock snaps into engagement, the trunk lid is held firmly and fairly rigidly in position as the tension of the spring assembly 18 is sufficient to allow the device to act as a substantially rigid link.

The tube discourages unauthorized personnel from disengaging the device from the hasp 12 so that the trunk lock key (not illustrated) is required to allow the trunk lid to disengage from the portion 21 of the assembly so that the lid is held in a rigid partially open position and unauthorized access is difficult.

The device hereinbefore described is adapted for use with a conventional clam shell type snap engaging lock assembly. However, some automobiles manufactured in Japan and Europe (e.g. Volkswagon Rabbit), as well as some cars manufactured by the Ford Motor Company (e.g. Ford Escort) use a single latch hook 38 which swings across and engages the hasp 21, from a housing 39 in which the latch hook 38 is not shielded by the housing 39A of FIG. 1.

When travelling over uneven surfaces, there is a possibility that the member 21 will become disengaged from the latch hook 38 thus permitting the trunk to open fully.

Figure 10:
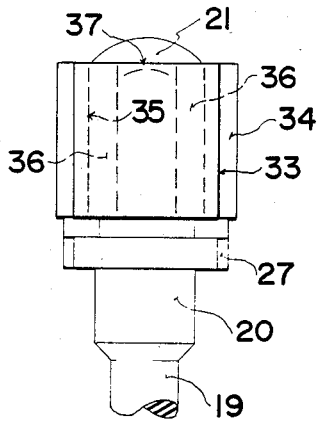
FIG. 10 is a front elevation of FIG. 9.
Figure 9:
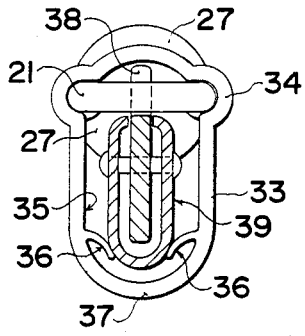
FIG. 9 is a top plan view of FIG. 8 showing same engaged over the upper end of the spring assembly.
Figure 8:
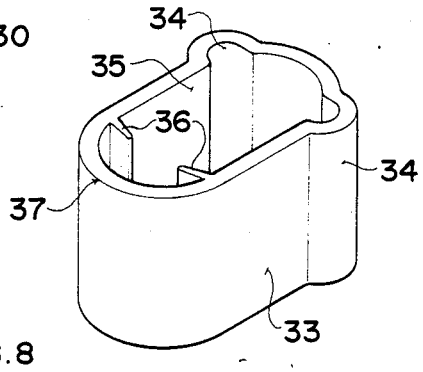
FIG. 8 is an isometric view of a shield portion required with some makes of automobiles.

In order to avoid this, a shield, preferably plastic, is utilized as illustrated in FIGS. 8, 9 and 10. It consists of a substantially oval hollow member 33 shown in FIG. 8 and having a pair of vertically situated internal grooves 34 formed in opposite walls 35, with the grooves being on the inner surfaces thereof. These frictionally engage over the member 21 and embrace the legs 21A and this, together with two vertical fins 36 extending inwardly from adjacent the outer end wall 37, prevent the single latch from inadvertently disengaging from the member 21. As shown in FIG. 9, the housing 39 is engaged by the shield with the vertical fins 36 flexing towards the rear end 37 to accommodate different thicknesses of the housing 39. This prevents any end to end motion from occurring thus preventing disengagement of the hasp from the hook 38.

FIGS. 11 and 12 illustrate, in a fragmentary form, a further type of latching mechanism found in some European cars which includes two accurately curved latching members 40 pivoted adjacent the inner ends thereof on pivot pins 41 and including spring catch mechanism (not illustrated). When the hasp 21 is struck by the portions 42 when the trunk is closed over the hasp, these latch members 40 snap together through the hasp as shown in FIG. 12 and can only be disengaged by use of the conventional key in the trunk lock.

In order to eliminate the excessive play which may exist under these circumstances, the elastomeric shoulder 27 is extended upwardly as at 27A, between the legs 21A of the hasp 21 terminating at a level indicated by reference character 43. Alternatively, this can be a separate portion held frictionally between the legs.

The latch members 40 normally engage a pin (not illustrated) rather than a loop such as loop 12 shown in FIGS. 6 and 7. This pin is provided with a free end and vibration may cause the hook 26 to slip off the end of this pin. If this constitutes a problem, then a stopper of rubber or synethetic plastic may be engaged frictionally over the free end of the pin to prevent this from occurring.

Finally it should be noted that when the device is mounted upon the hasp 12 with the notches 32 engaging thereover, the member 19 is under considerable tension so that in the remote possibility that the latch mechanism 13 becomes disengaged from the hasp 21, the assembly 18 cannot become disengaged from the loop 12 and cause damage to any following vehicle for example.

Since various modifications can be made in our invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What is claimed is:

1. In combination, a device for holding the trunk lid of an automobile or the like, in the partially opened position, said automobile including a lid lock engaging hasp situated adjacent the edge of the cargo space enclosed by the lid and a conventional snap lock mechanism on the trunk lid cooperatively engaging with the hasp to detachably secure said lid in the closed position, an open ended tube, a tension spring member extending freely therethrough, a snap lock engaging member secured to one end of said resilient spring member, means restricting the movement of said snap lock engaging member into one end of said tube, hook means on the other end of said tension spring member engagable with the lid lock engaging hasp and means on the other end of said tube selectively engagable with the outer surface of the lid lock engaging hasp when said hook means is engaged with said lid lock engaging hasp, said tension spring member being under relatively heavy tension at least when said means on the other end of said tube is selectively engagable with the outer surface of the lid lock engaging hasp so that it acts as a substantially rigid link between the trunk lid and the edge of the cargo space, when installed, said means on the other end of said tube selectively engagable with the outer surface of the lid lock engaging hasp including a pair of open ended recesses formed on the opposite side walls of the other end of said tube, in diametrically opposing relationship, said recesses engaging over said lid lock engaging hasp when installed.

2. A device for holding the trunk lid of an automobile or the like, in the partially opened position, said automobile including a lid lock engaging hasp situated adjacent the edge of the cargo space enclosed by the lid and a conventional snap lock mechanism on the trunk lid cooperatively engaging with the hasp to detachably secure said lid in the closed position; said device comprising in combination an open ended tube, a tension spring member under tension extending therethrough, a snap lock engaging member secured to one end of said resilient spring member, means restricting the movement of said snap lock engaging member into one end of said tube to maintain said spring member under tension, open hook means on the other end of said tension spring member engagable with the associated lid lock engaging hasp and means on the other end of said tube selectively engagable with the outer surface of the associated lid lock engaging hasp when said hook means is engaged with said lid lock engaging hasp, said tension spring member being pretensioned when assembled and under relatively heavy tension when said means on the other end of said tube is selectively engagable with the outer surface of the associated lid lock engaging hasp so that it acts as a substantially rigid link between the associated trunk lid and the edge of the car space, when installed, said snap lock engaging member including a closed ended hasp, said means restricting the movement of said snap lock engaging member into one end of said tube includes a shoulder between said hasp and said one end of said tension spring means, said shoulder engaging said one end of said tube, said means on the other end of said tube selectively engagable with the outer surface of the associated lid lock engaging hasp including a pair of open ended recesses formed on the opposite side walls of the other end of said tube, in diametrically opposing relationship, said recesses engaging over said lid lock engaging hasp when installed.

3. The device according to claim 1 which includes means on said other end of said tube for retaining said hook means with said tension spring means being maintained under relatively heavy tension as aforesaid, said means on said other end of said tube including a slot formed in the wall of said other end of said tube and extending upwardly therefrom, said slot having one open end at said other end of said tube and being closed at the other end thereof, said hook means engaging said slot.

4. The device according to claim 3 in which the depth of said slot is greater then the depth of said recesses.

5. A device for holding the trunk lid of an automobile or the like, in the partially opened position, said automobile including a lid lock engaging hasp situated adjacent the edge of the cargo space enclosed by the lid and a conventional snap lock mechanism on the trunk lid cooperatively engaging with the hasp to detachably secure said lid in the closed position; said device comprising in combination an open ended tube, a tension spring member under tension extending therethrough, a snap lock engaging member secured to one end of said resilient spring member, means restricting the movement of said snap lock engaging member into one end of said tube to maintain said spring member under tension, open hook means on the other end of said tension spring member engagable with the associated lid lock engaging hasp and means on the other end of said tube selectively engagable with the outer surface of the associated lid lock engaging hasp when said hook means is engaged with said lid lock engaging hasp, said tension spring member being pretensioned when assembled and under relatively heavy tension when said means on the other end of said tube is selectively engagable with the outer surface of the associated lid lock engaging hasp so that it acts as a substantially rigid link between the associated trunk lid and the edge of the car space, when installed, said snap lock engaging member including a closed ended hasp, said means restricting the movement of said snap lock engaging member into one end of said tube includes a shoulder between said hasp and said one end of said tension spring means, said shoulder engaging said one end of said tube and means on said other end of said tube for retaining said hook means with said tension spring means being maintained under relatively heavy tension as aforesaid, said means on said other end of said tube including a slot formed in the wall of said other end of said tube and extending upwardly therefrom, said slot having an open end at said other end of said tube and being closed at the other end thereof, said hook means engaging said slot.

6. The device according to claim 5 in which said means on the other end of said tube selectively engagable with the outer surface of the associated lid lock engaging hasp includes a pair of open ended recesses formed on the opposite side walls of the other end of said tube, in diametrically opposing relationship, said recesses engaging over said lid lock engaging hasp when installed.

7. The device according to claim 1, 6 or 3 in which said tension spring is formed from an elastomeric material.

8. The device according to claims 2, or 3 which include a shield detachably securable over said snap lock engaging member to restrict inadvertent sideways disengaging movement of said engaging member from associated snap lock mechanism.

9. The device according to claims 5 or 4 in which said tension spring is formed from an elastomeric material.

10. The device according to claims 5 or 4 which include a shield detachably securable over said snap lock engaging member to restrict inadvertent sideways disengaging movement of said engaging member from associated snap lock mechanism.

11. A device for holding the trunk lid of an automobile securely in the partially opened position, said automobile including a cargo space having a perimetrical edge defining same and a trunk lid detachably enclosing said cargo space, means on said lid and said edge cooperating together to detachably close and lock said lid in the closed position upon said perimetrical edge of said cargo space, said means including a fixed portion, including a lock engaging hasp and a movable and lockable portion, including a conventional snap lock mechanism; said device comprising in combination (a) an open ended tube,
(b) a tension spring member under tension extending through said tube;
(c) a snap lock engaging member secured to one end of said tension spring member,
(d) means restricting the movement of said snap lock engaging member into one end of said tube to maintain said spring member under tension;
(e) open hook means on the other end of said tension spring member engagable with the associated lid lock engaging hasp,
(f) and means on the other end of said tube selectively engagable with the outer surface of the associated lock engaging hasp when said hook means is engaged therewith,
(g) said tension spring member being pretensioned when assembled and under relatively heavy tension when said means on the other end of said tube is selectively engagable with the outer surface of the associated lock engaging hasp, so that it acts as a substantially rigid link between the associated trunk lid and the edge of the cargo space, when installed and means on the other end of said tube selectively engagable with the outer surface of the associated lid lock engaging hasp including a pair of open ended recesses formed on the opposite side walls of the other end of said tube, in diametrically opposing relationship, said recesses engaging over said lid lock engaging hasp when installed.

12. The device according to claim 11 which includes means on said other end of said tube for retaining said hook means with said tension spring means being maintained under relatively heavy tension as aforesaid, said means on said other end of said tube including a slot formed in the wall of said other end of said tube and extending upwardly therefrom, said slot having one open end at said other end of said tube and being closed at the other end thereof, said hook means engaging said slot.

13. The device according to claim 12 in which the depth of said slot is greater than the depth of said recesses.

14. A device for holding the trunk lid of an automobile securely in the partially opened position, said automobile including a cargo space having a perimetrical edge defining same and a trunk lid detachably enclosing said cargo space, means on said lid and said edge cooperating together to detachably close and lock said lid in the closed position upon said perimetrical edge of said cargo space, said means including a fixed portion, including a lock engaging hasp and a movable and lockable portion, including a conventional snap lock mechanism; said device comprising in combination (a) an open ended tube,
(b) a tension spring member under tension extending through said tube,
(c) a snap lock engaging member secured to one end of said tension spring member,
(d) means restricting the movement of said snap lock engaging member into one end of said tube to maintain said spring member under tension,
(e) open hook means on the other end of said tension spring member engagable with the associated lid lock engaging hasp,
(f) and means on the other end of said tube selectively engagable with the outer surface of the associated lock engaging hasp when said hook means is engaged therewith,
(g) said tension spring member being pretensioned when assembled and under relatively heavy tension when said means on the other end of said tube is selectively engagable with the outer surface of the associated lock engaging hasp, so that it acts as a substantially rigid link between the associated trunk lid and the edge of the cargo space, when installed, said snap lock engaging member including a closed ended hasp, said means restricting the movement of said snap lock engaging member into one end of said tube includes a shoulder between said hasp and said one end of said tension spring means, said shoulder engaging said one end of said tube and means on said other end of said tube for retaining said hook means with said tension spring means being maintained under relatively heavy tension as aforesaid, said means on said other end of said tube including a slot formed in the wall of said other end of said tube and extending upwardly therefrom, said slot having one open end at said other end of said tube and being closed at the other end thereof, said hook means engaging said slot.

15. The device according to claim 14 in which said means on the other end of said tube selectively engagable with the outer surface of the associated lid lock engaging hasp includes a pair of open ended recesses formed on the opposite side walls of the other end of said tube, in diametrically opposing relationship, said recesses engaging over said lid lock engaging hasp when installed.

16. The device according to claim 14 in which the depth of said slot is greater than the depth of said recesses.

17. The device according to claims 11, 15 or 12 in which said tension spring is formed from an elastomeric material.

18. The device according to claims 14, 13 or 16 in which said tension spring is formed from an elastomeric material.

19. The device according to claims 11 or 15 or 12 which include a shield detachably securable over said snap lock engaging member to restrict inadvertent sideways disengaging movement of said engaging member from associated snap lock mechanism.

20. The device according to claim 14 or 16 which include a shield detachably securable over said snap lock engaging member to restrict inadvertent sideways disengaging movement of said engaging member from the associated snap lock mechanism.

21. A shield for securement over a snap lock engaging member mounted in and extending from a housing, comprising in combination a hollow member, opposing channels formed in the wall of said hollow member extending from the upper side to the lower side and frictionally engaging over the legs of said snap lock engaging member, and a pair of opposing fins extending inwardly from the wall of said hollow member adjacent one end thereof, to receive, frictionally, a portion of the housing to prevent inadvertent disengagement of said snap lock engaging member.

* * * * *